US007794251B2

(12) United States Patent
Wen et al.

(10) Patent No.: US 7,794,251 B2
(45) Date of Patent: Sep. 14, 2010

(54) ELECTRONIC DEVICE HAVING REPLACEABLE PLUG

(75) Inventors: Ping-Hung Wen, Taoyuan Hsien (TW); Chun-Chen Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/049,506

(22) Filed: Mar. 17, 2008

(65) Prior Publication Data

US 2009/0117765 A1 May 7, 2009

(30) Foreign Application Priority Data

Nov. 7, 2007 (TW) ..... 96142081 A

(51) Int. Cl.
*H01R 29/00* (2006.01)

(52) U.S. Cl. ..... 439/173; 439/171; 320/111

(58) Field of Classification Search ..... 439/173, 439/172, 171, 131, 518; 320/107, 111, 113
See application file for complete search history.

(56) References Cited

U.S. PATENT DOCUMENTS 5,059,885 A * 10/1991 Weiss et al. ..... 320/115
5,613,863 A * 3/1997 Klaus et al. ..... 439/131
5,634,806 A * 6/1997 Hahn ..... 439/173
5,829,993 A * 11/1998 Wu ..... 439/131
6,320,353 B1 * 11/2001 Chiu et al. ..... 320/111
7,008,246 B2 * 3/2006 Zhuge ..... 439/173
7,118,339 B2 * 10/2006 Moroz et al. ..... 416/1
7,168,969 B1 * 1/2007 Wang ..... 439/173
7,179,105 B1 * 2/2007 Hung ..... 439/172
7,300,297 B1 * 11/2007 Wang et al. ..... 439/173

* cited by examiner

*Primary Examiner*—Xuong M Chung-Trans
(74) *Attorney, Agent, or Firm*—Kirton & McConkie; Evan R. Witt

(57) ABSTRACT

An electronic device includes a main body, a plug and a fixing member. The main body includes a plug-receiving portion and a plurality of conductive portions. The plug-receiving portion is defined by a first sidewall, a second sidewall and a bottom surface. The first sidewall is opposed to the second sidewall. The bottom surface is connected to the first sidewall and the second sidewall. An inclined angle between the bottom surface and at least one of the first sidewall and the second sidewall is smaller than 90 degrees. The plug includes a plurality of conductive terminals, a first slant corresponding to the first sidewall, and a second slant corresponding to the second sidewall. The fixing member is used for facilitating fixing the plug in the plug-receiving portion of the main body such that the conductive terminals of the plug are electrically connected to the conductive portions of the main body.

20 Claims, 9 Drawing Sheets

2

52

ELECTRONIC DEVICE HAVING REPLACEABLE PLUG

FIELD OF THE INVENTION

The present invention relates to an electronic device having a replaceable plug, and more particularly to a power converter having a replaceable plug.

BACKGROUND OF THE INVENTION

Power converters such as power adapters or chargers become indispensable electronic devices for many kinds of electrical apparatuses. For example, by means of the power adapters, the utility power may be rectified and then converted into DC power for supplying power-receiving devices such as notebook computers. Alternatively, by means of the chargers, the converted DC power may be charged into the rechargeable batteries of the power-receiving devices such as mobile phones or digital cameras.

The power converter includes a plug for plugging into a socket to receive utility power. Since the international business is well developed and the leisure life quality is much valued nowadays, people frequently go abroad for business or travel. When they go abroad, they usually carry the portable electronic products, such as notebooks, mobile phones and digital cameras. However, since there are various kinds of socket standards in the world, the power converter is usually connected with a connector having different forms of conductive terminals in order to comply with different socket standards.

FIG. 1 is a schematic exploded view showing a power converter with a replaceable plug according to the prior art. The power converter 10 principally comprises a main body 11 and diverse plugs 12. The main body 11 has a plug-receiving portion for receiving one of the diverse plugs 12 therein such that the selected plug 12 is combined with the main body 11. The receptacle inside the main body has a circuit board (not shown). Via the selected plug 12, external utility power is transmitted to the circuit board. By the circuit board, the utility power is rectified and then converted into DC power for supplying power-receiving devices. Alternatively, the converted DC power may be charged into the rechargeable batteries of the power-receiving devices.

The main body 11 further includes a plug-receiving portion 111 with bilateral guiding slots, a resilient fixing member 112 and a plurality of conductive portions 113. The plug-receiving portion 111 is arranged in one surface of the main body 11. The resilient fixing member 112 is disposed at the lower edge of the plug-receiving portion 111. A seam 114 is formed beside a periphery of the resilient fixing member 112 such that the fixing member 112 is flexible. Due to the flexible property of the fixing member 112, the fixing member 112 is flexibly moved in response to an external force. The conductive portions 113 are disposed within the plug-receiving portion 111. The first ends of the conductive portions 113 are electrically connected to the circuit board inside the main body 11.

Each plug 12 includes a plurality of conductive terminals 121 on one side thereof. The other side of the plug 12 includes guiding tracks 122, a plurality of recesses 123 and an engaging indentation 124. The conductive terminals 121 may be used to receive external utility power. The number and the shapes of the conductive terminals 121 may be designed according to different socket standards. The guiding tracks 122 are disposed on bilateral sides of the plug 12 and mated with the bilateral guiding slots of the plug-receiving portion 111. When the plug 12 is slid into the plug-receiving portion 111 of the main body 11, the guiding tracks 122 and the guiding slots are engaged with each other for preventing from detachment of the plug 12. The recesses 123 are mated with the conductive portions 113. When the plug 12 is slid into the plug-receiving portion 111 of the main body 11, the conductive portions 113 are contacted with the conductive terminals 121 and thus the conductive terminals 121 are electrically connected to the circuit board inside the main body 11. The engaging indentation 124 is arranged between the recesses 123 and mated with the resilient fixing member 112. When the plug 12 is slid into the plug-receiving portion 111 of the main body 11, the resilient fixing member 112 is engaged with the engaging indentation 124 of the plug 12 such that the plug 12 is fixed in the plug-receiving portion 111.

Although the plugs 12 of the power converter 10 may be designed according to different socket standards, there are still some drawbacks. For facilitating assembling the plug 12 with the main body 11, the plug-receiving portion 111 of the main body has bilateral guiding slots, and the plug 12 has guiding tracks 122 and recesses 123. As a consequence, the configuration of the power converter 10 is complicated and not cost-effective. In addition, it is difficult to assemble the power converter 10.

To overcome the disadvantages of the prior art described above, the present invention provides a power converter having a replaceable plug.

SUMMARY OF THE INVENTION

It is an object of the present invention to provide a power converter having a replaceable plug, which may be designed according to different socket standards.

Another object of present invention provides an electronic device having a replaceable plug. The electronic device has a simplified configuration and is easily assembled.

In accordance with an aspect of the present invention, there is provided an electronic device having a replaceable plug. The electronic device includes a main body, a plug and a fixing member. The main body includes a plug-receiving portion and a plurality of conductive portions. The plug-receiving portion is defined by a first sidewall, a second sidewall and a bottom surface. The first sidewall is opposed to the second sidewall. The bottom surface is connected to the first sidewall and the second sidewall. An inclined angle between the bottom surface and at least one of the first sidewall and the second sidewall is smaller than 90 degrees. The plug includes a plurality of conductive terminals, a first slant corresponding to the first sidewall, and a second slant corresponding to the second sidewall. The fixing member is used for facilitating fixing the plug in the plug-receiving portion of the main body such that the conductive terminals of the plug are electrically connected to the conductive portions of the main body. The first slant and the second slant of the plug are respectively mated with the first sidewall and the second sidewall of the plug-receiving portion.

In accordance with another aspect of the present invention, there is provided an electronic device having a replaceable plug. The electronic device includes a main body and a plug. The main body includes a plug-receiving portion, a plurality of conductive portions and a fixing member. The plug-receiving portion is defined by a first sidewall, a second sidewall and a bottom surface. The first sidewall is opposed to the second sidewall. The bottom surface is connected to the first sidewall and the second sidewall. An inclined angle between the bottom surface and at least one of the first sidewall and the second sidewall is smaller than 90 degrees. The plug includes a base and an insulating body and a plurality of conductive terminals. The base includes a first slant corresponding to the first sidewall, and a second slant corresponding to the second sidewall. The insulating body is interconnected between the conductive terminals and the base. The base of the plug is fixed in the plug-receiving portion of the main body via the fixing member such that the conductive terminals of the plug are electrically connected to the conductive portions of the main body. The first slant and the second slant of the plug are respectively mated with the first sidewall and the second sidewall of the plug-receiving portion.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
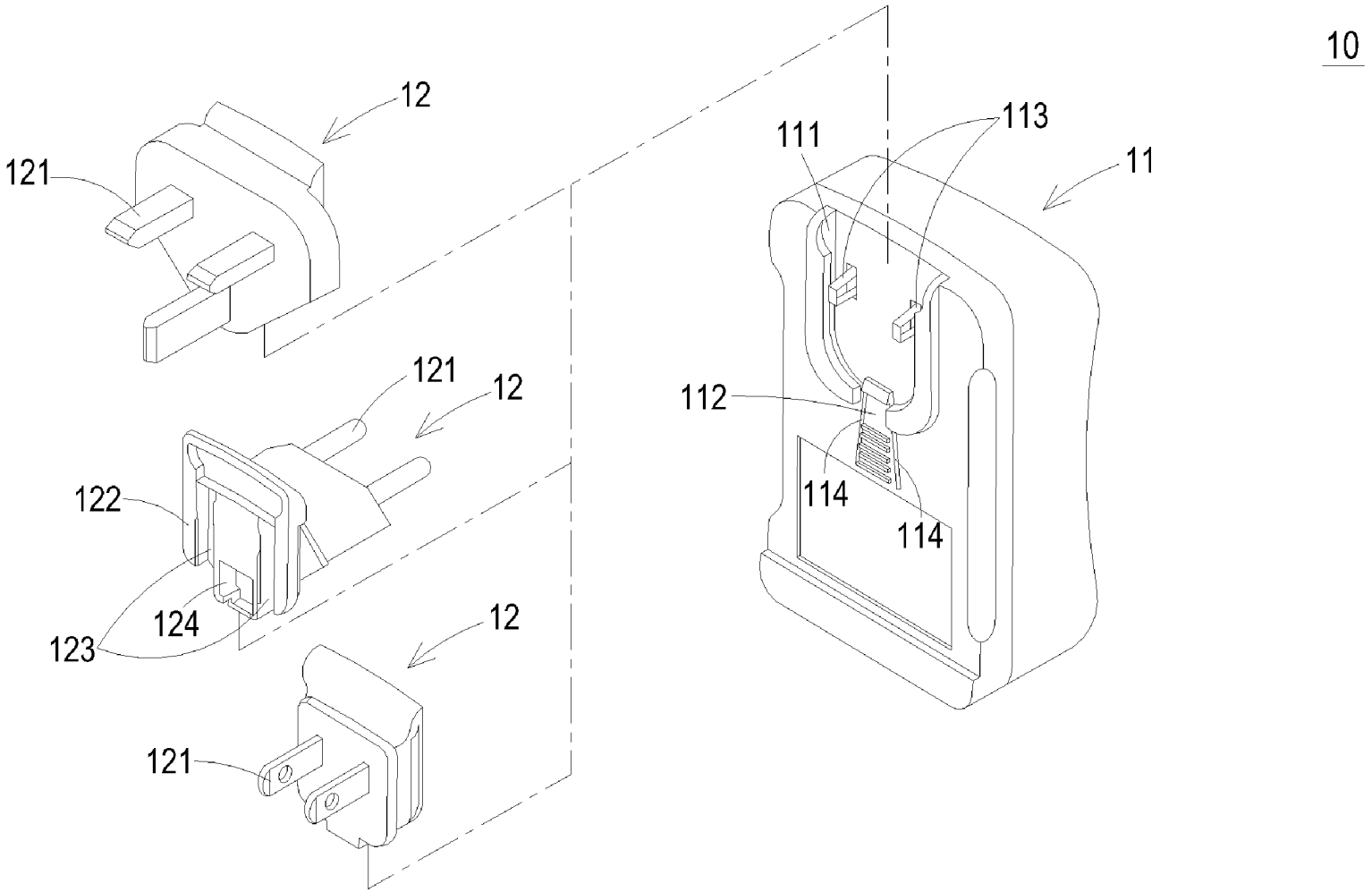
FIG. 1 PRIOR ART
FIG. 1 is a schematic exploded view showing a power converter with a replaceable plug according to the prior art.
Figure 2A:
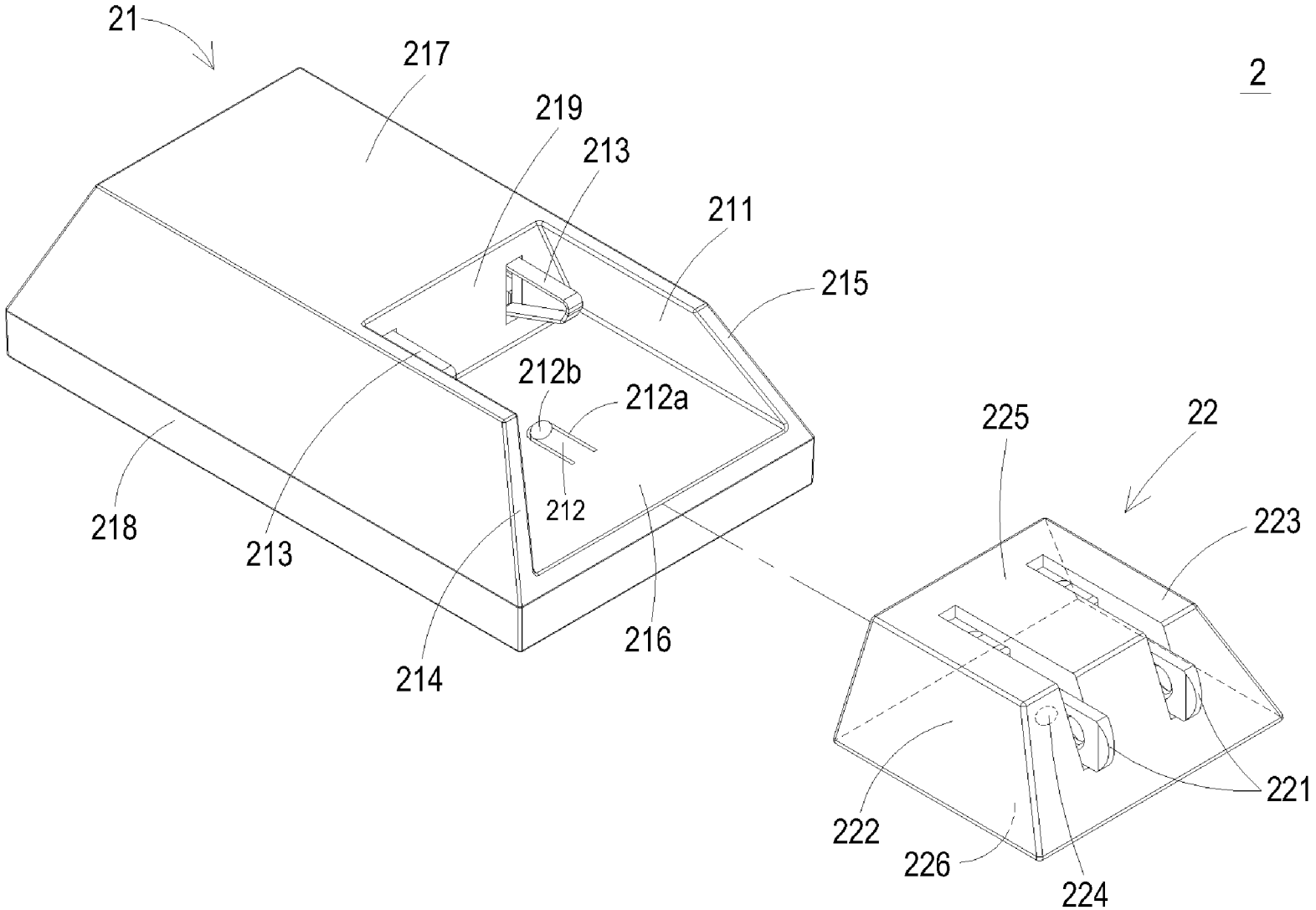
FIG. 2A is a schematic exploded view of an electronic device with a replaceable plug according to a preferred embodiment of the present invention.

Referring to FIG. 2A, a schematic exploded view of an electronic device with a replaceable plug according to a preferred embodiment of the present invention is illustrated. As shown in FIG. 2A, the electronic device 2 is for example a power converter such as a power adapter or a charger. The electronic device 2 principally includes a main body 21 and a plug 22. The main body 21 further includes a plug-receiving portion 211, at least a fixing member 212 and a plurality of conductive portions 213. The plug-receiving portion 211 is arranged in one surface of the main body 21 for receiving the plug 22 therein. The plug-receiving portion 211 is defined by a first sidewall 214, a second sidewall 215, a bottom surface 216 and a third sidewall 219. The first sidewall 214 and the second sidewall 215 are opposed to each other. The third sidewall 219 is arranged between the first sidewall 214 and the second sidewall 215 and perpendicular to the bottom surface 216. The conductive portions 213 are protruded from the third sidewall 219 and preferably flexible. Alternatively, the conductive portions 213 are disposed on the bottom surface 216.

The first sidewall 214 has a uniform thickness. The second sidewall 215 also has a uniform thickness. Alternatively, the thicknesses of the first sidewall 214 and the second sidewall 215 are varied according to practical requirements. The inclined angle between the bottom surface 216 and at least one of the first sidewall 214 and the second sidewall 215 is smaller than 90 degrees. Consequently, one or both of the first sidewall 214 and the second sidewall 215 are inwardly slanted. When the plug 22 is slid into the plug-receiving portion 211, the plug 22 is engaged with the plug-receiving portion 211 via the fixing member 212. The plug 22 includes a plurality of conductive terminals 221, a first slant 222 corresponding to the first sidewall 214, and a second slant 223 corresponding to the second sidewall 215. The tilting angles of the first slant 222 and the second slant 223 are mated with the inclined angles of the first sidewall 214 and the second sidewall 215, respectively.

Once the plug 22 is received in the plug-receiving portion 211, the conductive terminals 221 are electrically connected to the conductive portions 213 of the main body 21. In this embodiment, the main body 21 includes an upper casing 217 and a lower casing 218. The electronic device 2 has a circuit board (not shown) inside the main body 21. Via the plug 22, external utility power is transmitted to the circuit board. By the circuit board, the utility power may be rectified and then converted into DC power for supplying power-receiving devices. Alternatively, the converted DC power may be charged into the rechargeable batteries of the power-receiving devices.

In this embodiment, the fixing member 212 is integrally formed on the bottom surface 216 of the plug-receiving portion 211. A protrusion 212*b* is formed on an end of the fixing member 212. A seam 212*a* is formed beside a periphery of the fixing member 212 such that the fixing member 212 is flexible. Due to the flexible property of the fixing member 212, the fixing member 212 is flexibly moved in response to an external force.

Figure 2B:
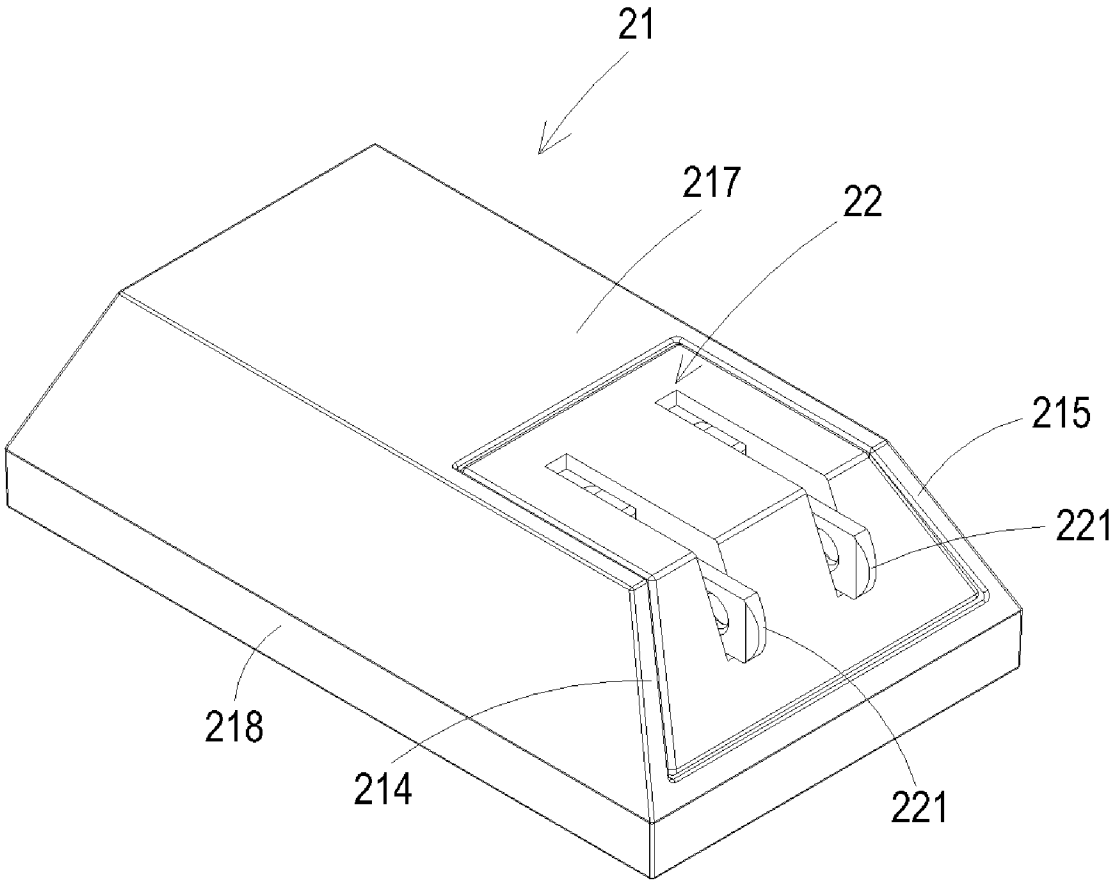
FIG. 2B is a schematic assembled view of the electronic device shown in FIG. 2A.
Figure 2C:
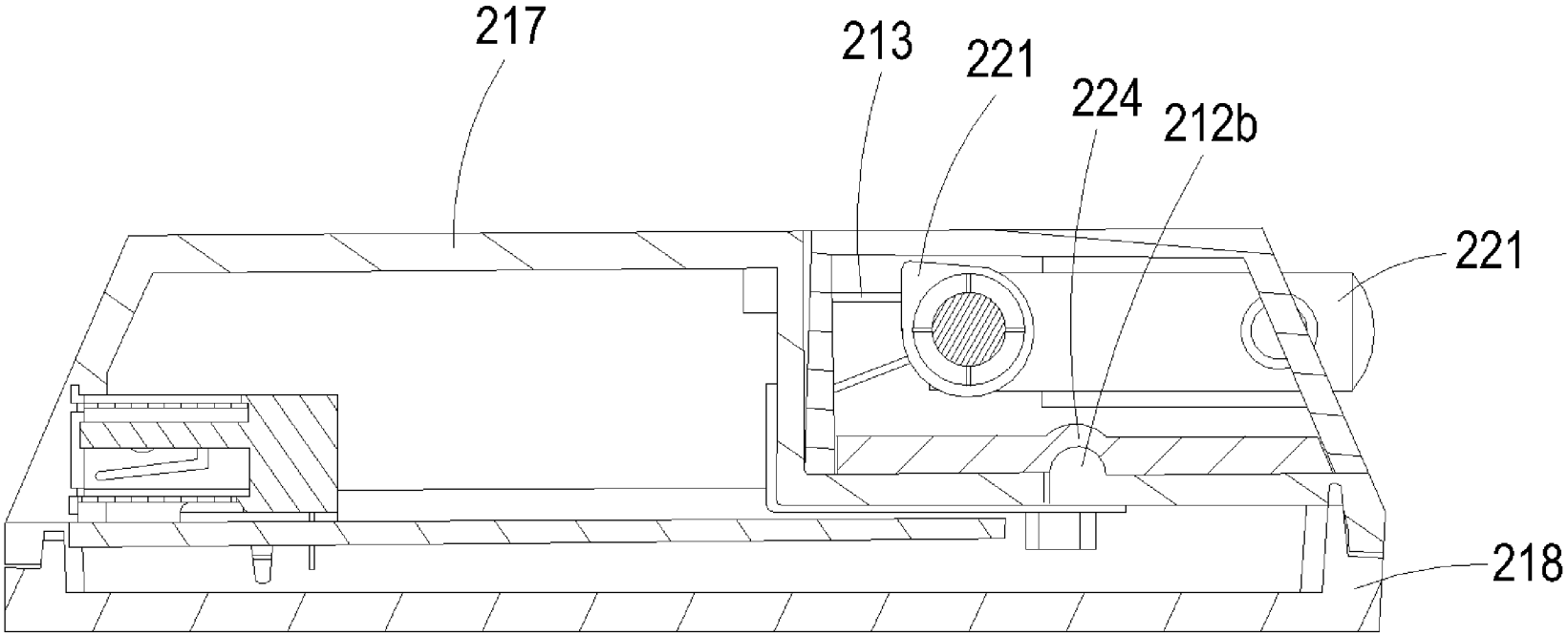
FIG. 2C is a schematic cross-sectional view of the electronic device shown in FIG. 2A.
Figure 2D:
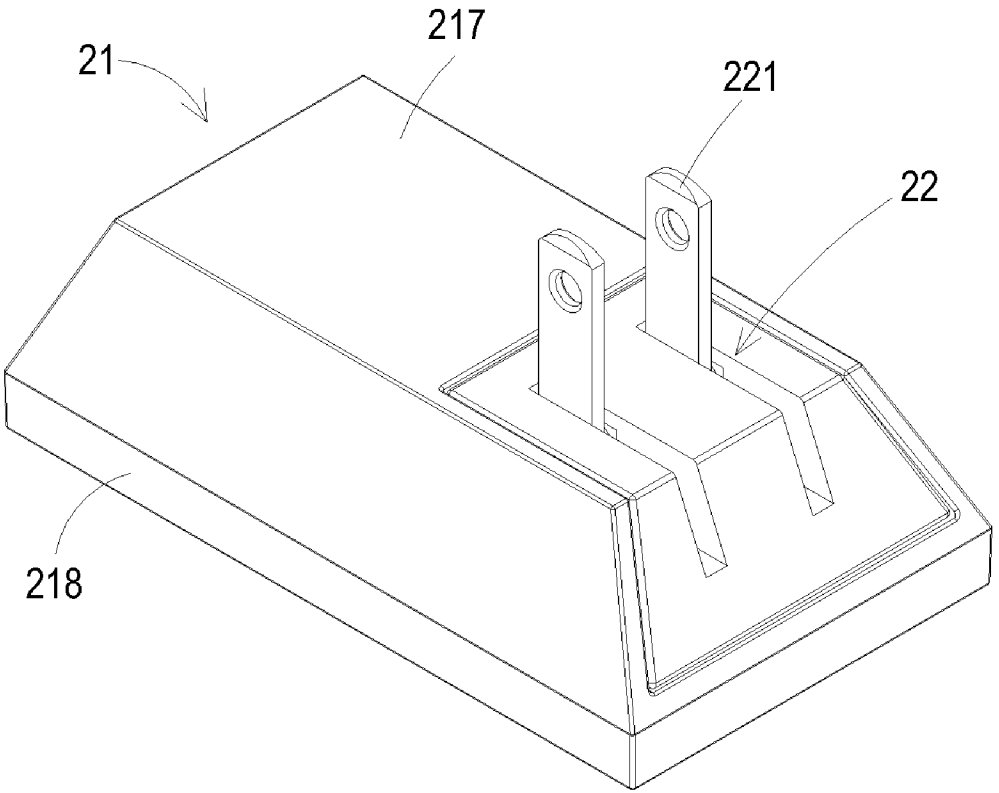
FIG. 2D is a schematic perspective view illustrating that the conductive terminals are rotated to be perpendicular to the upper surface of the plug for receiving electricity.

The plug 22 further has an upper surface 225 and a lower surface 226. The upper surface 225 and the lower surface 226 are connected to the first slant 222 and the second slant 223. In some embodiments, the conductive terminals 221 are foldable. During operation of the electronic device 2, the conductive terminals 221 are rotated to a first position where the conductive terminals 221 are perpendicular to the upper surface 225, as is shown in FIG. 2D. As a consequence, the conductive terminals 221 of the plug 22 may be inserted into a power socket for receiving electricity. When the electronic device 2 is not in use, the conductive terminals 221 may be folded to a second position where the conductive terminals 221 are substantially parallel with the upper surface 225. In some embodiments, the conductive terminals 221 are fixed on the upper surface 225 and not foldable.

Moreover, corresponding to the protrusion 212*b* of the fixing member 212, an engaging structure 224 (e.g. an indentation) is formed in the lower surface 226 of the plug 22. When the plug 22 is slid into the plug-receiving portion 211 of the main body 21, the protrusion 212*b* of the fixing member 212 is engaged with the engaging structure 224 of the plug 22 such that the plug 22 is fixed in the plug-receiving portion 211. Under this circumstance, the conductive terminals 221 of the plug 22 are contacted with the conductive portions 213 of the main body 21, as is shown in FIGS. 2B and 2C. It is noted that, however, those skilled in the art will readily observe that numerous modifications and alterations may be made while retaining the teachings of the invention. For example, the engaging structure 224 and the engaging structure 224 may have any complementary shapes as long as they are coupled with each other.

FIG. 2B and 2C are schematic assembled and cross-sectional views or the electronic device, respectively. In FIG. 2D, the conductive terminals 221 of the plug 22 are rotated to an operating position for receiving electricity. Hereinafter, a process of assembling the main body 21 with the plug 22 will be illustrated with reference to FIGS. 2A, 2B, 2C and 2D.

First of all, the plug 22 is slid into the plug-receiving portion 211 of the main body 21 toward the third sidewall 219 of the plug-receiving portion 211, in which the first slant 222 and the second slant 223 are respectively mated with the first sidewall 214 and the second sidewall 215 of the plug-receiving portion 211. Due to the flexible property of the fixing member 212, the protrusion 212*b* of the fixing member 212 is pressed down by the lower surface 226 of the plug 22 and sunken toward the lower casing 218 during the plug 22 is slid into the plug-receiving portion 211. Until the engaging structure 224 of the plug 22 is aligned with the protrusion 212*b* of the fixing member 212, the fixing member 212 is restored to its original position to be engaged with the engaging structure 224. Meanwhile, the plug 22 is sustained against the third sidewall 219 of the plug-receiving portion 211 and the conductive terminals 221 of the plug 22 are contacted with the conductive portions 213 of the main body 21. In a case that the conductive terminals 221 of the plug 22 are folded, the upper surface of the upper casing 217 and the upper surface 225 of the plug 22 are substantially coplanar, as can be seen in FIGS. 2B and 2C. For transmitting electricity to the circuit board inside the main body 21, the conductive terminals 221 are rotated to be perpendicular to the upper surface 225, as is shown in FIG. 2D.

For complying with different kinds of socket standards, the plug 22 needs to be disassembled from the main body 21. In response to an external force exerted on the third sidewall 219 of the plug-receiving portion 211 through the plug 22, the fixing member 212 is deformed and sunken toward the lower casing 218 such that the engaging structure 224 of the plug 22 is no longer engaged with the engaging structure 224 of the plug 22. Meanwhile, the plug 22 may be withdrawn from the plug-receiving portion 211.

Figure 3A:
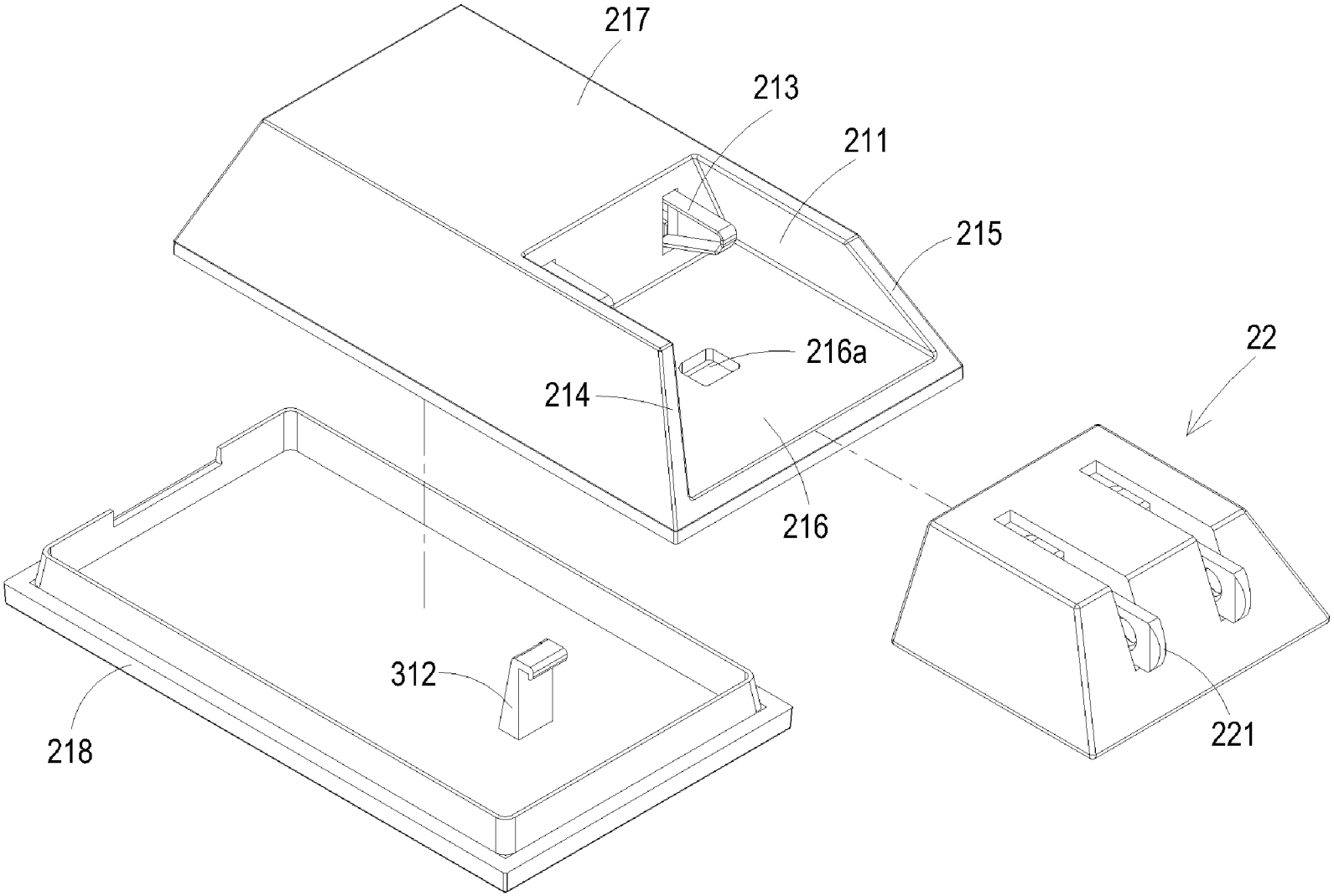
FIG. 3A is a schematic exploded view of an electronic device with a replaceable plug according to another preferred embodiment of the present invention.
Figure 3B:
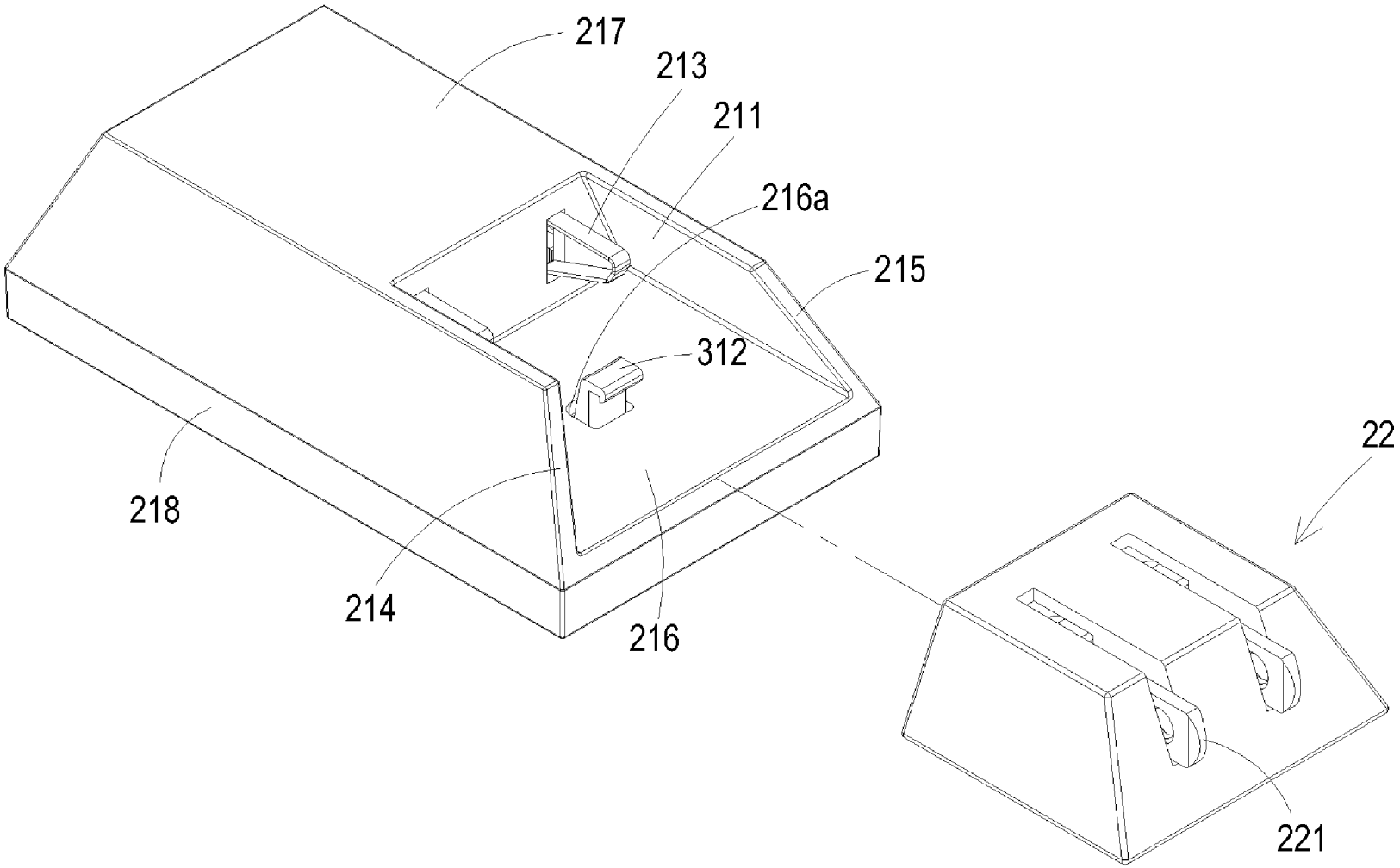
FIG. 3B is a schematic assembled view of the electronic device shown in FIG. 3A.

It is noted that, however, those skilled in the art will readily observe that numerous modifications and alterations may be made while retaining the teachings of the invention. For example, as shown in FIG. 3A, the bottom surface 216 of the upper casing 217 of the main body 21 has a perforation 216*a* and a hook element 312 is protruded from an inner surface of the lower casing 218. When the upper casing 217 and the lower casing 218 are combined together, the hook element 312 is penetrated through the perforation 216*a* and partially protruded from the bottom surface 216 of the main body 21, as can be seen in FIG. 3B. When the plug 22 is slid into the plug-receiving portion 211 of the main body 21, the hook element 312 is engaged with the engaging structure (not shown) of the plug 22 such that the plug 22 is fixed in the plug-receiving portion 211. In response to an external force exerted on the bottom of the lower casing 218, the hook element 312 is disengaged from the engaging structure of the plug 22. Furthermore, in response to a counterforce, the plug 22 will be withdrawn from the plug-receiving portion 211.

Figure 4:
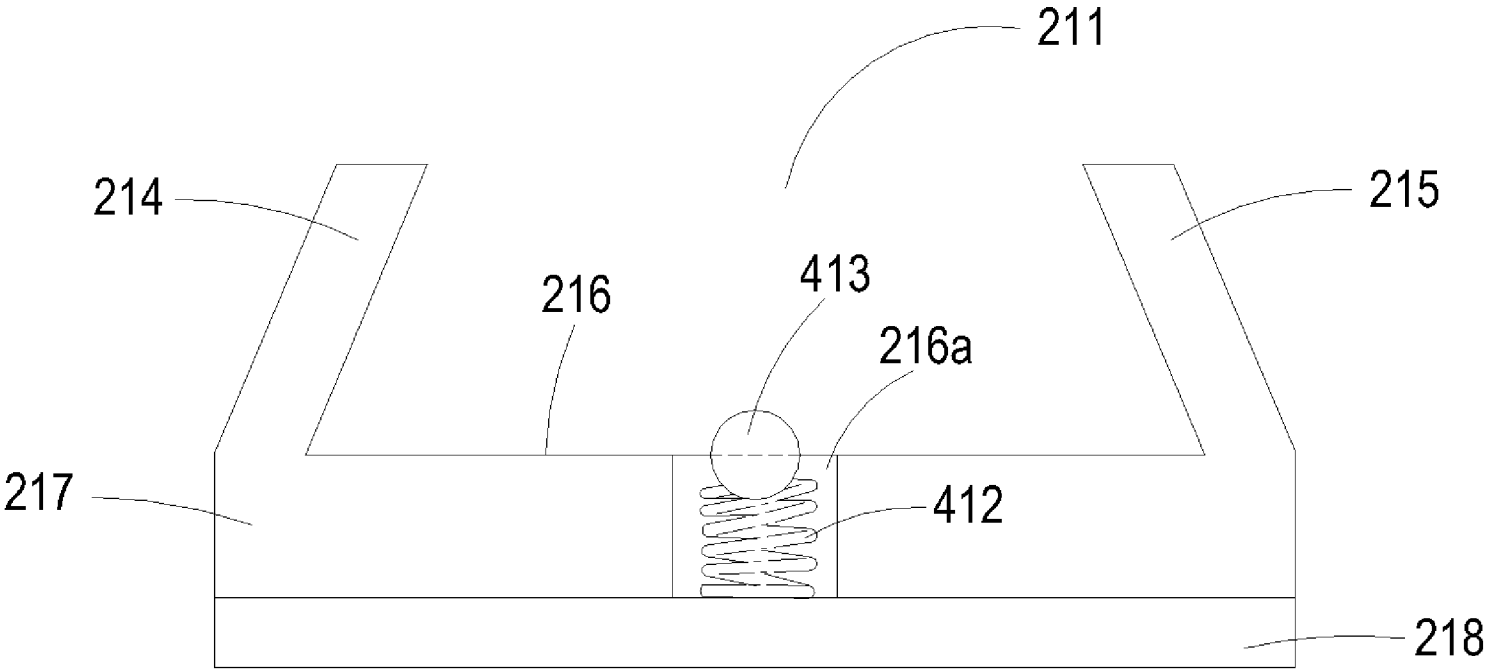
FIG. 4 is a schematic cross-sectional view illustrating a variation of the main body of the electronic device of FIG. 2A.

FIG. 4 is a schematic cross-sectional view illustrating a variation of the main body of the electronic device of FIG. 2A. The fixing member of the main body includes a resilient element 412 and a fastening element 413. A first end of the resilient element 412 is fixed on the lower casing 218 or the circuit board (not shown). The second end of the resilient element 412 is coupled to the fastening element 413. The bottom surface 216 of the main body 21 has a perforation 216*a* corresponding to the resilient element 412 and the fastening element 413. When the upper casing 217 and the lower casing 218 are combined together, the resilient element 412 and the fastening element 413 are penetrated through the perforation 216*a* and partially protruded from the bottom surface 216 of the main body 21. When the plug 22 is slid into the plug-receiving portion 211 of the main body 21, the fastening element 413 is pressed down and the resilient element 412 is compressed. Until the fastening element 413 is engaged with the engaging structure of the plug 22, the plug 22 is fixed in the plug-receiving portion 211.

In the embodiments, the fixing member is arranged on the bottom surface 216 of the plug-receiving portion 211. Alternatively, the fixing member may be arranged on the first sidewall 214 and/or the second sidewall 215. Moreover, the fixing member of the main body and the engaging structure of the plug 22 may be modified. For example, salient points (not shown) are provided on the first slant 222 and the second slant 223 of the plug 22. Corresponding to the salient points, the first sidewall 214 and the second sidewall 215 of the plug-receiving portion 211 has indentations. Due to engagements of the salient points and the indentations, the plug 22 is fixed in the plug-receiving portion 211.

Figure 5:
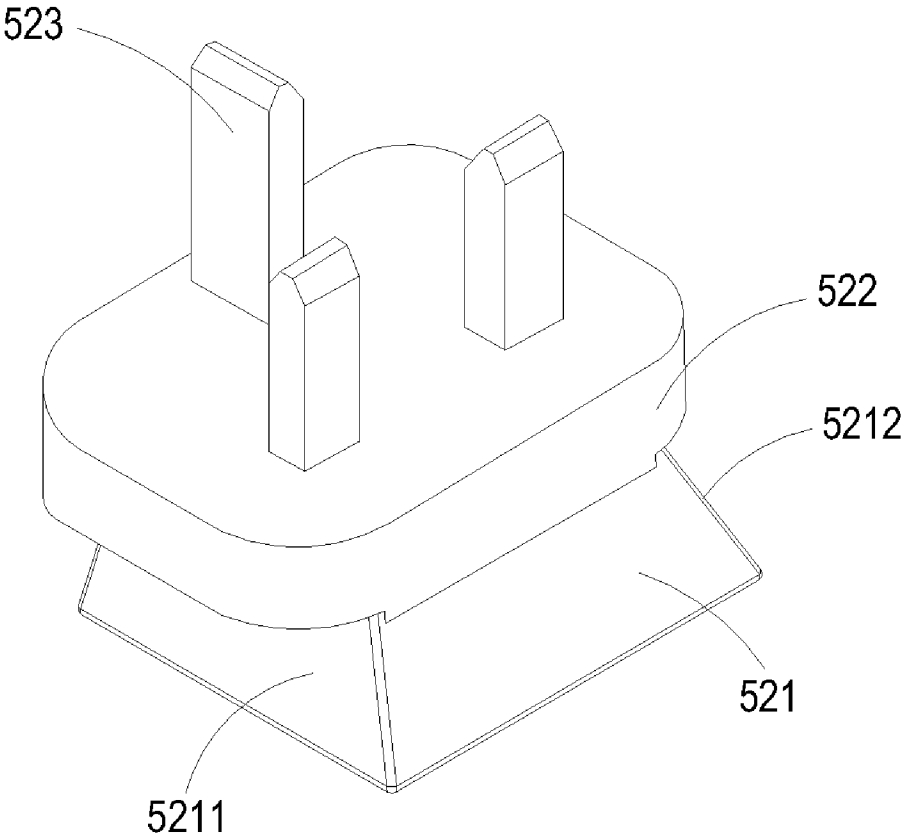
FIG. 5 is a schematic cross-sectional view illustrating a variation of the plug of the electronic device of FIG. 2A.

The number and the shapes of the conductive terminals 221 may be designed according to different socket standards. FIG. 5 is a schematic cross-sectional view illustrating a variation of the plug of the electronic device of FIG. 2A. As shown in FIG. 5, the plug 52 includes a base 521, an insulating body 522 and three conductive terminals 523. The insulating body 522 is interconnected between the conductive terminals 523 and the base 521. The base 521 has a first slant 5211 corresponding to the first sidewall 214 and a second slant 5212 corresponding to the first sidewall 215. The tilting angles of the first slant 5211 and the second slant 5212 are mated with the inclined angles of the first sidewall 214 and the second sidewall 215 of the main body 21, respectively. As a consequence, the plug 52 may be fixed in the plug-receiving portion 211 of the main body 52.

From the above embodiment, the plug of the electronic device provided by the present invention is replaceable to adapt to different socket standards. Since the first slant and the second slant are respectively mated with the first sidewall and the second sidewall of the plug-receiving portion, the plug and the main body of the electronic device can be easily assembled and dissembled. In addition, the electronic device has a simplified configuration and is easily assembled.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electronic device having a replaceable plug, said electronic device comprising:

a main body including a plug-receiving portion and a plurality of conductive portions, said plug-receiving portion being a trench defined by a first sidewall, a second sidewall and a bottom surface, said first sidewall being opposed to said second sidewall, said bottom surface being connected to said first sidewall and said second sidewall, wherein an inclined angle between said bottom surface of said trench and at least one of said first sidewall and said second sidewall of said trench is smaller than 90 degrees;

a plug including a plurality of conductive terminals, a first slant corresponding to said first sidewall, and a second slant corresponding to said second sidewall; and a fixing member for facilitating fixing said plug in said plug-receiving portion of said main body such that said conductive terminals of said plug are electrically connected to said conductive portions of said main body, wherein said first slant and said second slant of said plug are respectively mated with said first sidewall and said second sidewall of said plug-receiving portion.

2. The electronic device according to claim 1 wherein said plug-receiving portion is defined by said first sidewall, said second sidewall, said bottom surface and further a third sidewall, and said conductive portions are protruded from said third sidewall.

3. The electronic device according to claim 1 wherein said plurality of conductive terminals of said plug are foldable conductive terminals or fixed conductive terminals, and said plurality of conductive terminals include two or three conductive terminals.

4. The electronic device according to claim 1 wherein said fixing member is integrally formed on said bottom surface of said plug-receiving portion, and a seam is formed beside a periphery of said fixing member such that said fixing member is flexible.

5. The electronic device according to claim 4 wherein a protrusion is formed on an end of said fixing member to be engaged with an engaging structure of said plug, so that said plug is fixed in said plug-receiving portion of said main body.

6. The electronic device according to claim 1 wherein said first sidewall has a uniform thickness and said second sidewall has a uniform thickness.

7. The electronic device according to claim 1 wherein said bottom surface of said main body has a perforation.

8. The electronic device according to claim 7 wherein said fixing member includes:

a resilient element having a first end fixed on said lower casing; and a fastening element coupled to a second end of said resilient element, wherein said resilient element and said fastening element are penetrated through said perforation and partially protruded from said bottom surface of said main body.

9. The electronic device according to claim 7 wherein said fixing member includes a hook element, wherein a first end of said hook element is fixed on an inner surface of said lower casing and a second end of said hook element is penetrated through said perforation and partially protruded from said bottom surface of said main body.

10. The electronic device according to claim 1 wherein said conductive portions are flexible.

11. An electronic device having a replaceable plug, said electronic device comprising:

a main body including a plug-receiving portion, a plurality of conductive portions and a fixing member, said plug-receiving portion being a trench defined by a first sidewall, a second sidewall and a bottom surface, said first sidewall being opposed to said second sidewall, said bottom surface being connected to said first sidewall and said second sidewall, wherein an inclined angle between said bottom surface of said trench and at least one of said first sidewall and said second sidewall of said trench is smaller than 90 degrees; and a plug including a base and an insulating body and a plurality of conductive terminals, said base including a first slant corresponding to said first sidewall, and a second slant corresponding to said second sidewall, said insulating body is interconnected between said conductive terminals and said base, said base of said plug being fixed in said plug-receiving portion of said main body via said fixing member such that said conductive terminals of said plug are electrically connected to said conductive portions of said main body, wherein said first slant and said second slant of said plug are respectively mated with said first sidewall and said second sidewall of said plug-receiving portion.

12. The electronic device according to claim 11 wherein said plug-receiving portion is defined by said first sidewall, said second sidewall, said bottom surface and further a third sidewall, and said conductive portions are protruded from said third sidewall.

13. The electronic device according to claim 11 wherein said plurality of conductive terminals of said plug are foldable conductive terminals or fixed conductive terminals, and said plurality of conductive terminals include two or three conductive terminals.

14. The electronic device according to claim 11 wherein said fixing member is integrally formed on said bottom surface of said plug-receiving portion, and a seam is formed beside a periphery of said fixing member such that said fixing member is flexible.

15. The electronic device according to claim 14 wherein a protrusion is formed on an end of said fixing member to be engaged with an engaging structure of said plug, so that said plug is fixed in said plug-receiving portion of said main body.

16. The electronic device according to claim 11 wherein said first sidewall has a uniform thickness and said second sidewall has a uniform thickness.

17. The electronic device according to claim 11 wherein said bottom surface of said main body has a perforation.

18. The electronic device according to claim 17 wherein said fixing member includes:

a resilient element having a first end fixed on said lower casing; and a fastening element coupled to a second end of said resilient element, wherein said resilient element and said fastening element are penetrated through said perforation and partially protruded from said bottom surface of said main body.

19. The electronic device according to claim 17 wherein said fixing member includes a hook element, wherein a first end of said hook element is fixed on an inner surface of said lower casing and a second end of said hook element is penetrated through said perforation and partially protruded from said bottom surface of said main body.

20. The electronic device according to claim 11 wherein said conductive portions are flexible.

* * * * *